US007748817B2

(12) United States Patent
Akase

(10) Patent No.: US 7,748,817 B2
(45) Date of Patent: Jul. 6, 2010

(54) LIQUID EJECTION APPARATUS AND METHOD FOR CLEANING LIQUID EJECTION APPARATUS

(75) Inventor: Takashi Akase, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 776 days.

(21) Appl. No.: 11/723,099

(22) Filed: Mar. 16, 2007

(65) Prior Publication Data

US 2007/0216720 A1 Sep. 20, 2007

(30) Foreign Application Priority Data

Mar. 16, 2006 (JP) ..... 2006-072666

(51) Int. Cl.
*B41J 2/165* (2006.01)

(52) U.S. Cl. ..... 347/22; 347/23

(58) Field of Classification Search ..... 347/17, 347/22–36

See application file for complete search history.

(56) References Cited

U.S. PATENT DOCUMENTS 6,578,949 B2 * 6/2003 Takahashi et al. ..... 347/23

FOREIGN PATENT DOCUMENTS

JP 8-104013 A 4/1996
JP 9-150529 A 6/1997
JP 11-192728 A 7/1999
JP 2001-001558 A 1/2001
JP 2002-350568 A 12/2002
JP 2006-95819 A 4/2006
JP 2006-95820 A 4/2006
JP 2006-192823 A 7/2006

* cited by examiner

*Primary Examiner*—Juanita D Stephens
(74) *Attorney, Agent, or Firm*—Sughrue Mion, PLLC

(57) ABSTRACT

A liquid ejection apparatus including a liquid ejection head having a nozzle, a cleaning mechanism, and a controller. The controller includes a timer device, first memory section, second memory section, power supply, determining section, and tracked time correction section. If determination of the determining section is positive when the power supply is resumed, the tracked time correcting section reads out tracked time information from the second memory section and causes the timer device to start time tracking from the time indicated by the tracked time information that was stored when power supply to the liquid ejection apparatus was stopped. If the controller determines that the difference between the tracked time and the end time indicated by end time information stored in the first memory section is longer than or equal to a predetermined period, the controller operates the cleaning mechanism to carry out the cleaning.

8 Claims, 7 Drawing Sheets

LIQUID EJECTION APPARATUS AND METHOD FOR CLEANING LIQUID EJECTION APPARATUS

CROSS-REFERENCE TO RELATED APPLICATION

This application is based upon and claims the benefit of priority from prior Japanese Patent Application No. 2006-072666, filed on Mar. 16, 2006, the entire contents of which is incorporated herein by reference.

FIELD OF THE INVENTION

The present invention relates to a liquid ejection apparatus and a method for cleaning a liquid ejection apparatus.

BACKGROUND

Typically, an inkjet printer is known as a liquid ejection apparatus that ejects liquid from a recording head, or a liquid ejection head, onto a target. The inkjet printer ejects ink (liquid) onto a sheet of recording paper (a target). The printer includes a recording head and a recording paper sheet transport mechanism. The recording head is mounted in a carriage that reciprocates in a main scanning direction. The recording paper sheet transport mechanism transports recording paper sheets in a sub scanning direction. Nozzles are defined in the recording head for ejecting the ink, which is supplied from a cartridge, onto the recording paper sheet. The printer also includes a cleaning mechanism having a cap capable of sealing a nozzle forming surface of the recording head. The cleaning mechanism performs cleaning on the nozzles by drawing the ink from inside the nozzles Further, a controller of the printer includes a timer device (RTC) that tracks time and a time information memory device (EEPROM), which stores the time at which cleaning has ended as previous end time information. The controller operates the cleaning mechanism to perform cleaning (referred to also as "timer cleaning") when the difference (or, the elapsed period) between the time tracked by the timer device and the time indicated by the previous end time information, which is stored in the time information memory device, is longer than or equal to a predetermined period (for example, seven days).

The printer has a power supply, or a capacitor, which supplies power to the timer device when the power source of the printer is turned off. Therefore, even when the power source of the printer is deactivated, time tracking by the timer device is sustained as long as the capacitance of the capacitor permits (for example, for four days). However, if the power source of the printer is held in a turned off state longer than the period permitted by the capacitance of the capacitor, supply of the power to the timer device by the capacitor is stopped. The time tracking by the timer device is thus stopped.

To solve this problem, as described in Japanese Laid-Open Patent Publication No. 11-192728, a printer may be connected to an external device such as a host computer. When the power source of the printer is turned on, the printer receives information regarding the current time from the external device and corrects the time tracked by a timer device correspondingly. The time tracked by the timer device of the printer thus becomes substantially accurate. This prevents the timer cleaning from being performed unnecessarily before a predetermined period elapses after the previous cleaning, thus suppressing waste of ink.

Further, as has been recently proposed, a printer may be connected directly to a recording medium, or an external memory, instead of being connected to an external device. The printer executes printing based on printing information stored in the recording medium. When the power source of this printer is turned on, information regarding the current time is not received from the external device. In other words, if time tracking by the timer device has stopped before the power source is turned on, the controller of the printer cannot acquire the current time, as referred to FIG. 10. Accordingly, when the power source is turned on, the timer device must start the time tracking from an initial state and a cleaning mechanism performs cleaning to prevent a defect in ink ejection.

Therefore, without being connected to the external device, the printer of Japanese Laid-Open Patent Publication No. 11-192728 may also perform unnecessary cleaning when the power source of the printer is turned on. Also in this case, excessively repeated cleaning causes undesirable ink loss.

SUMMARY

Accordingly, it is an objective of the present invention to provide a liquid ejection apparatus and a method for cleaning a liquid ejection apparatus that suppress waste of liquid caused by excessive cleaning without receiving time information from an external device.

According to a first aspect of the invention, a liquid ejection apparatus including a liquid ejection head having a nozzle, a cleaning mechanism that performs cleaning of the nozzle by drawing a liquid from inside the nozzle, and a controller that controls operation of the liquid ejection apparatus is provided. The controller includes a timer device that tracks time, a first memory section, a second memory section, a power supply, a determining section, and a tracked time correction section. The first memory section stores an end time at which a previous cycle of the cleaning has ended as end time information. The second memory section stores a tracked time tracked by the timer device as tracked time information. The power supply is charged when a power is supplied to the liquid ejection apparatus and supplies the charged power to the timer device when power supply to the liquid ejection apparatus is stopped. The determining section determines whether time tracking by the timer device is stopped. If determination of the determining section is positive when the power supply to the liquid ejection apparatus is resumed after having been stopped, the tracked time correcting section reads out the tracked time information from the second memory section and causes the timer device to start the time tracking from the time indicated by the tracked time information that was stored when power supply to the liquid ejection apparatus was stopped. If the controller determines that the difference between the tracked time tracked by the timer device and the end time indicated by the end time information stored in the first memory section is longer than or equal to a predetermined period, the controller operates the cleaning mechanism to carry out the cleaning.

In accordance with a second aspect of the present invention, another liquid ejection apparatus including a liquid ejection head having a nozzle, a cleaning mechanism that performs cleaning of the nozzle by drawing a liquid from inside the nozzle, and a controller that controls operation of the liquid ejection apparatus is provided. The controller includes a timer device that tracks time, a first memory section, second memory section, a power supply, a determining section, and a tracked time correcting section. The first memory section stores an end time at which a previous cycle of the cleaning has ended as end time information. The second memory section stores a tracked time tracked by the timer device as tracked time information. The power supply is charged when a power is supplied to the liquid ejection apparatus and supplies the charged power to the timer device when power supply to the liquid ejection apparatus is stopped. The determining section determines whether time tracking by the timer device is stopped. If determination of the determining section is positive when the power supply to the liquid ejection apparatus is resumed after having been stopped, the tracked time correcting section reads out the tracked time information from the second memory section and causes the timer device to start the time tracking from the time determined by adding a predetermined correcting period to the time indicated by the tracked time information that was stored when power supply to the liquid ejection apparatus was stopped. If the difference between the tracked time tracked by the timer device and the end time indicated by the end time information stored in the first memory section is longer than or equal to a predetermined period, the controller operates the cleaning mechanism to carry out the cleaning.

In accordance with a third aspect of the present invention, a method for cleaning a liquid ejection apparatus is provided. The liquid ejection apparatus has a liquid ejection head including a nozzle. Cleaning is performed on the nozzle by drawing a liquid from inside the nozzle. The method includes: tracking time; storing an end time at which a previous cycle of the cleaning has ended as end time information; storing tracked time information of the tracked time; determining whether time tracking is stopped; causing, if the determining is positive when the power supply to the liquid ejection apparatus is resumed after having been stopped, a timer device to start the time tracking from the time indicated by the tracked time information that was stored when power supply to the liquid ejection apparatus was stopped; and performing the cleaning if the difference between the tracked time and the end time indicated by the end time information is longer than or equal to a predetermined period.

In accordance with a fourth aspect of the present invention, another method for cleaning a liquid ejection apparatus is provided. The liquid ejection apparatus has a liquid ejection head including a nozzle. Cleaning is performed on the nozzle by drawing a liquid from inside the nozzle. The method includes: tracking time; storing an end time at which a previous cycle of the cleaning has ended as end time information; storing tracked time information of the tracked time tracked by a timer device; determining whether time tracking is stopped; causing, if the determining is positive when the power supply to the liquid ejection apparatus is resumed after having been stopped, the timer device to start the time tracking from the time determined by adding a predetermined correcting period to the time indicated by the tracked time information that was stored when power supply to the liquid ejection apparatus was stopped; and performing the cleaning if the difference between the tracked time and the end time indicated by the end time information is longer than or equal to a predetermined period.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

A first embodiment of the present invention, or an inkjet printer, will hereafter be explained with reference to FIGS. 1 to 7. In the following description, the directions "frontward", "rearward", "right", "left", "upper", and "lower" refer to the directions indicated by the corresponding arrows of FIG. 1.

Figure 1:
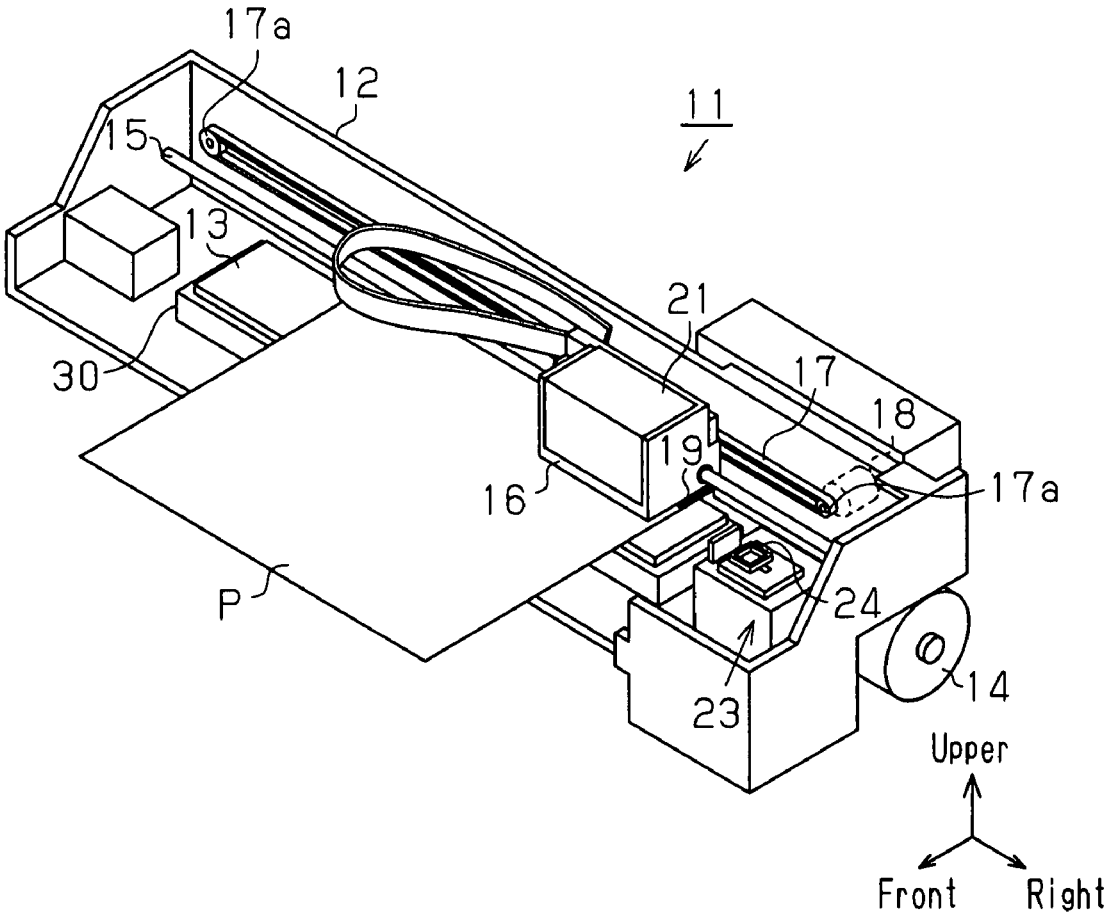
FIG. 1 is a perspective view schematically showing an inkjet printer according to a first embodiment of the present invention.

As shown in FIG. 1, an inkjet printer 11, or a liquid ejection apparatus, has a frame 12 having a rectangular shape as viewed from above. A platen 13, which extends in the left-and-right direction, is provided in the frame 12. A paper feeder mechanism having a paper feeder motor 14, which is provided externally from the frame 12, sends a sheet of recording paper P to a position on the platen 13. A bar-like guide member 15 is arranged above the platen 13 in the frame 12, extending parallel with the longitudinal direction, or the left-and-right direction, of the platen 13.

The guide member 15 supports a carriage 16 in such a manner as to allow reciprocation of the carriage 16 in the axial direction, or the left-and-right direction, of the guide member 15. A portion of the carriage 16 is fixed to a timing belt 17, which is wound around a pair of pulleys 17*a* provided on a rear inner surface of the frame 12. A carriage motor 18 is actuated to reciprocate the timing belt 17, which causes the carriage 16 to reciprocate along the guide member 15.

Figure 2:
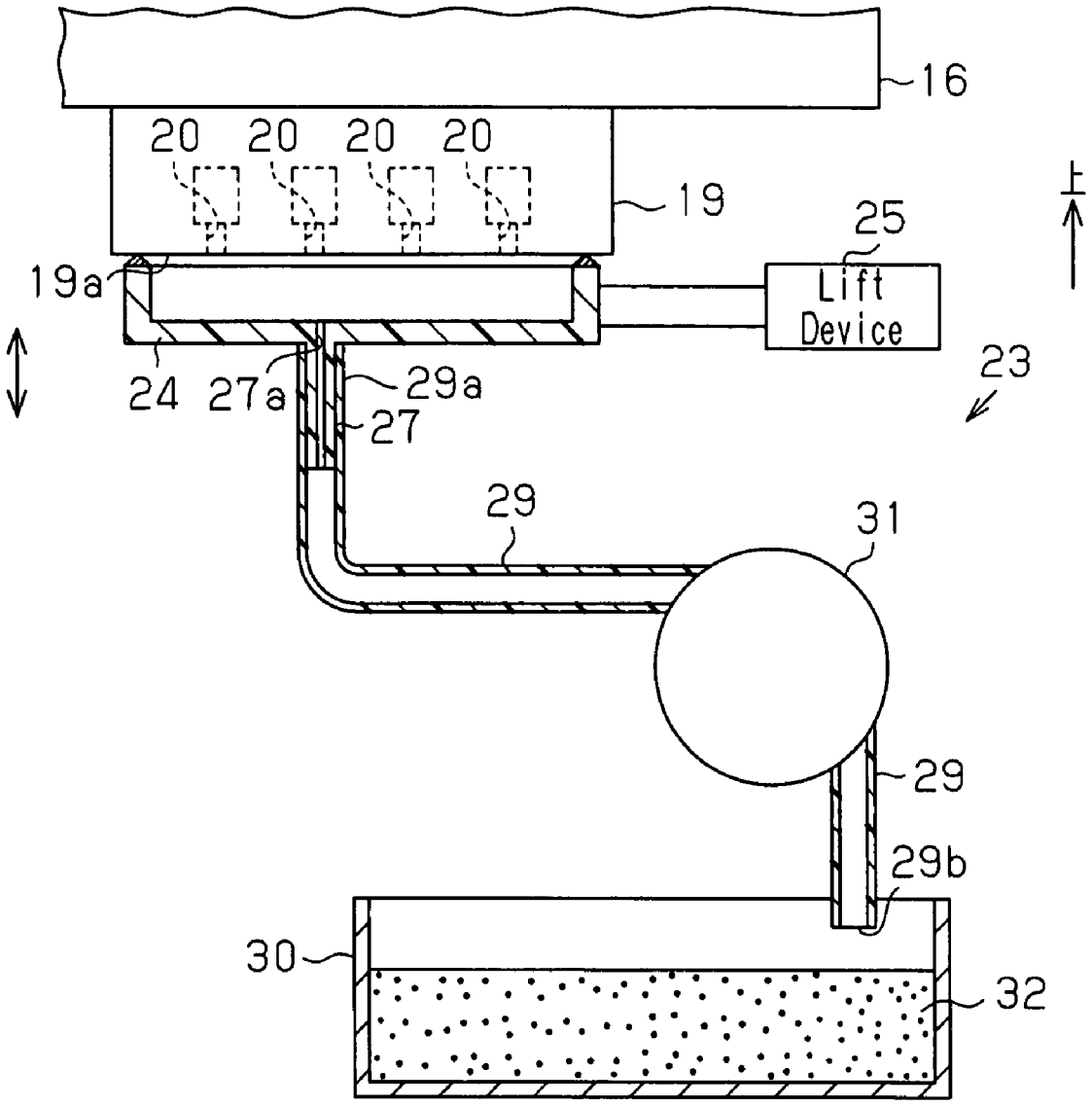
FIG. 2 is a diagrammatic view showing a cleaning mechanism of the first embodiment.

A recording head 19, or a liquid ejection head, is provided on the lower surface of the carriage 19. As shown in FIG. 2, the lower surface of the recording head 19 forms a nozzle forming surface 19*a* in which a plurality of (only four are shown in FIG. 2) nozzles 20 are defined. Referring to FIG. 1, at least one cartridge 21 is removably mounted in the carriage 16 at a position above the recording head 19. The cartridge 21 retains ink, or liquid, in such a manner as to supply the ink to the recording head 19.

Specifically, the ink is supplied from the cartridge 21 to the recording head 19 through excitement of a non-illustrated piezoelectric element arranged in the recording head 19. The ink is then ejected from the corresponding ones of the nozzles 20 of the recording head 19 onto the recording paper sheet P, which has been supplied to the platen 13. Printing is thus performed on the recording paper sheet P. A cleaning mechanism 23 is arranged in the vicinity of a home position area defined in a non-printing area, which is located at the right end in the interior of the frame 12. The cleaning mechanism 23 operates to clean the nozzle forming surface 19*a* of the recording head 19 when printing is not performed.

The cleaning mechanism 23 will be further described, referring to FIG. 2.

As shown in FIG. 2, the cleaning mechanism 23 has a cap 24, or a sealing member having a rectangular box-like shape, and a lift device 25, which selectively raises and lowers the cap 24. When the carriage 16 is located in the home position area, the cleaning mechanism 23 raises the cap 24 by means of the lift device 25 to seal the nozzle forming surface 19*a* of the recording head 19, or the nozzles 20, by the cap 24. An extending portion 27 extends downward from the bottom surface of the cap 24 and has a drainage line 27*a*. The drainage line 27*a* extends through the extended portion 27 in the up-and-down direction to drain the ink from the interior of the cap 24.

An upper end 29*a* of a drainage tube 29 formed of flexible material is connected to the extended portion 27. A lower end 29*b* of the drainage tube 29 is arranged in a waste ink tank 30. A suction pump 31 is provided in an intermediate portion of the drainage tube 29, which extends from the cap 24 to the waste ink tank 30. When the suction pump 31 is operated, the ink is drawn from the nozzles 20 of the recording head 19 and flows through the drainage tube 29. The ink is then drained into the waste ink tank 30 from the lower end 29*b* of the drainage tube 29. The waste ink tank 30 accommodates a waste ink absorbing material 32, which is formed of porous material.

The electric configuration of the printer 11 will now be described with reference to FIG. 3.

Figure 3:
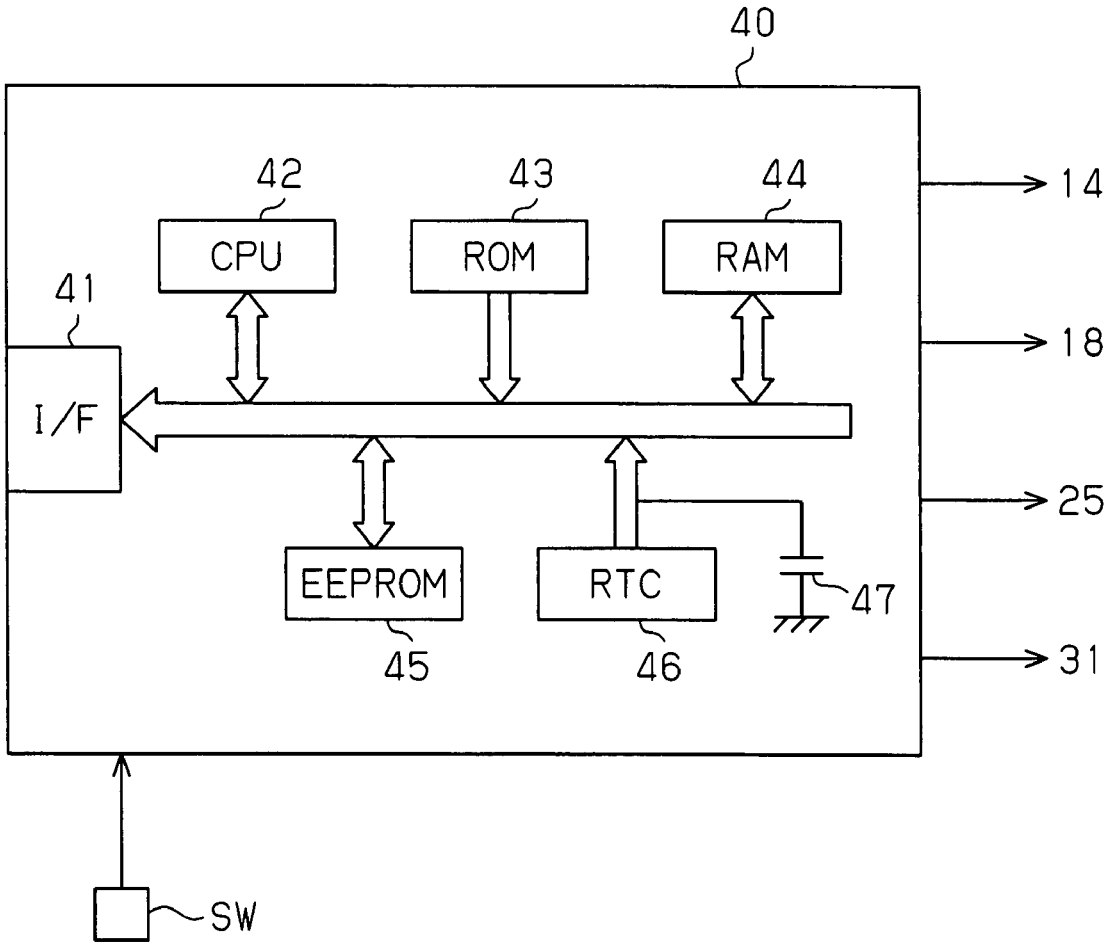
FIG. 3 is a block diagram representing the electric configuration of the first embodiment.

As illustrated in FIG. 3, the printer 11 has a controller 40. A power source switch SW is electrically connected to the controller 40 and manipulated to start or stop supply of the power to the printer 11. The power source switch SW outputs a signal that indicates manipulation of the power source switch SW to the controller 40, for example, when the power source switch SW is manipulated by the user. If the controller 40 receives the signal from the power source switch SW when the power is being supplied to the printer 11, the controller 40 operates to stop the printer 11 and then stop the power supply to the printer 11. Contrastingly, if the controller 40 receives the signal from the power source switch SW when the power supply to the printer 11 is suspended, the controller 40 operates to resume the power supply to the printer 11.

The paper feeder motor 14, the carriage motor 18, the lift device 25, and the suction pump 31 are electrically connected to the controller 40. The controller 40 controls operation of the motors 14, 18, the lift device 25, and the suction pump 31.

The controller 40 also includes an interface 41, a CPU 42, a ROM 43, a RAM 44, an EEPROM (Electronically Erasable and Programmable Read Only Memory) 45, and an RTC (Real Time Clock) 46. The ROM 43 stores various types of control programs and information (including a predetermined period, which will be later described) to control the printer 11. The RAM 44 stores various types of information that is rewritten as needed in operation of the printer 11. The EEPROM 45 stores various types of information (regarding, for example, power-off time and end time, which will be later explained) that must not be deleted even if the power supply to the printer 11 is stopped.

The RTC 46 tracks time. In the first embodiment, the RTC 46 functions as a timer device that tracks the time. A capacitor 47 is arranged in the controller 40 and functions as a power supply that is electrically connected to the RTC 46 and arranged in parallel with the RTC 46. When the power is supplied to the printer 11 (the controller 40), the power is charged in the capacitor 47. When the power supply to the printer 11 (the controller 40) is stopped, the capacitor 47 supplies the power to the RTC 46 in correspondence with the capacitance (permitted amount of charge) of the capacitor 47. Therefore, even when the power supply to the printer 11 is stopped, the RTC 46 is allowed to track time as long as the capacitor 47 supplies the power to the RTC 46 (for example, for four days).

Figure 4:
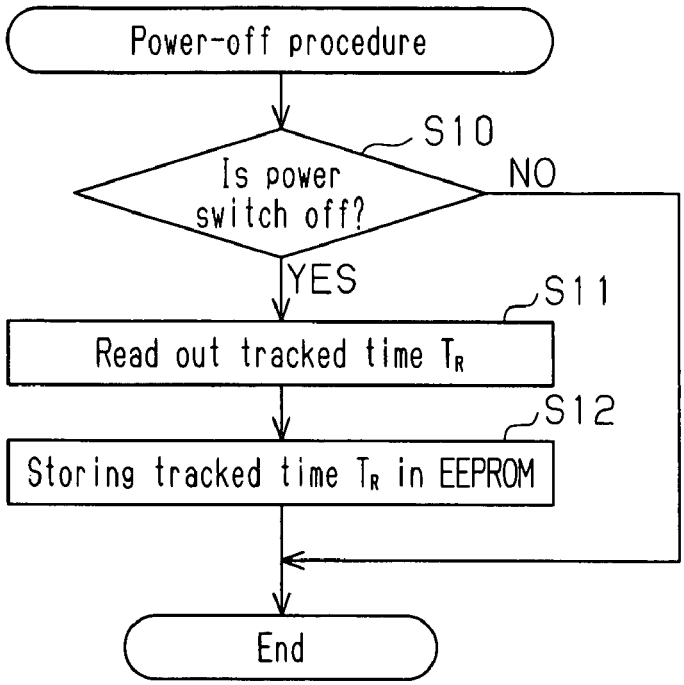
FIG. 4 is a flowchart representing a routine of a power-off procedure of the first embodiment.

Next, from the control routines executed by the controller 40 of the first embodiment, a routine of a power-off procedure, a routine of a power-on procedure, and a routine of a timer cleaning procedure will be explained with reference to the flowcharts of FIGS. 4 to 6 and the timing chart of FIG. 7. The routine of the power-off procedure is performed if the power source switch SW is manipulated while the printer 11 is in operation, or the power source is in a turned-on state. The routine of the power-on procedure is carried out to correct tracked time, which will be later explained, when the power supply to the printer 11 is started. The routine of the timer cleaning procedure is performed to periodically carry out cleaning. In the timing chart of FIG. 7, the tracked time is corrected.

The routine of the power-off procedure of FIG. 4 will be described with reference to the timing chart of FIG. 7.

The controller 40 executes the routine of the power-off procedure at predetermined cycles (for example, every 0.1 second). In step S10 of the routine, the controller 40 determines whether the power source switch SW is off. In other words, the controller 40 determines whether a signal was sent from the power source switch SW with the power supplied to the printer 11. If determination in step S10 is negative, the controller 40 ends the routine of the power-on procedure.

If the determination in step S10 is positive, or the controller 40 determines that the power source switch SW has been turned off, the controller 40 reads out the tracked time $T_R$, which is tracked by the RTC 46 in step S11. In step S12, the controller 40 sets the tracked time $T_R$ obtained in step S11 to power-off time $T_{off}$ and stores the power-off time $T_{off}$ in a predetermined area of the EEPROM 45 as power-off time information (tracked time information).

Figure 7:
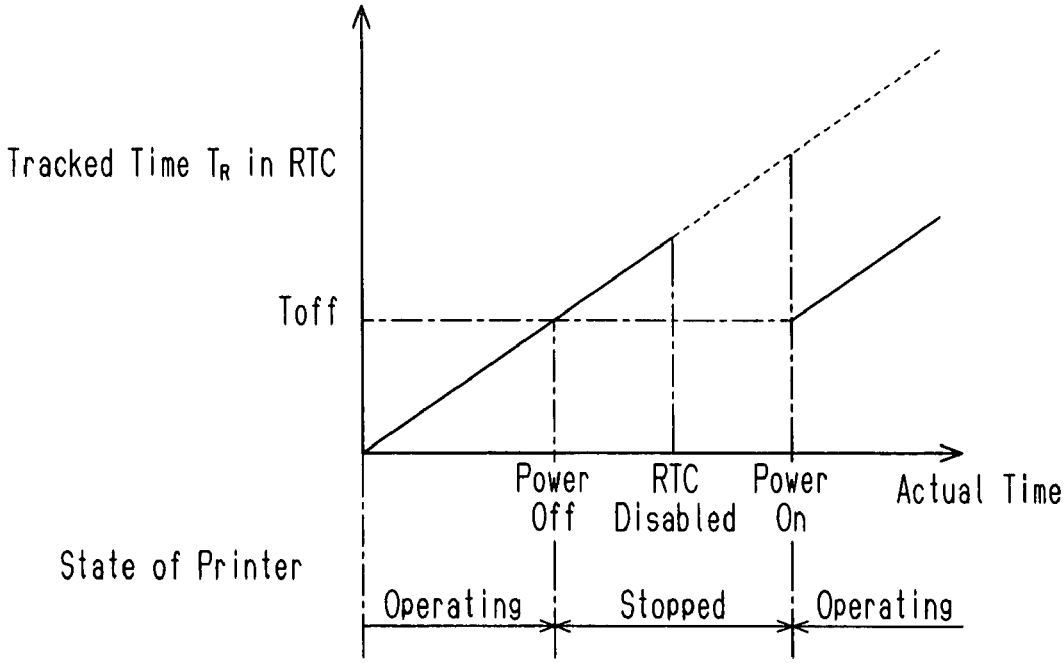
FIG. 7 is a timing chart representing correction of tracked time of the first embodiment.

Specifically, if the power source switch SW is turned off while the printer 11 is in operation (the power supply to the printer 11 is stopped), as illustrated in FIG. 7, the tracked time $T_R$ currently tracked by the RTC 46 is set as the power-off time $T_{off}$. Therefore, in this regard, the EEPROM 45 of the first embodiment functions also as a tracked time information memory section. Following step S12, the controller 40 ends the routine of the power-off procedure. As long as the power is supplied to the RTC 46 by the capacitor 47, the time tracking by the RTC 46 continues.

Figure 5:
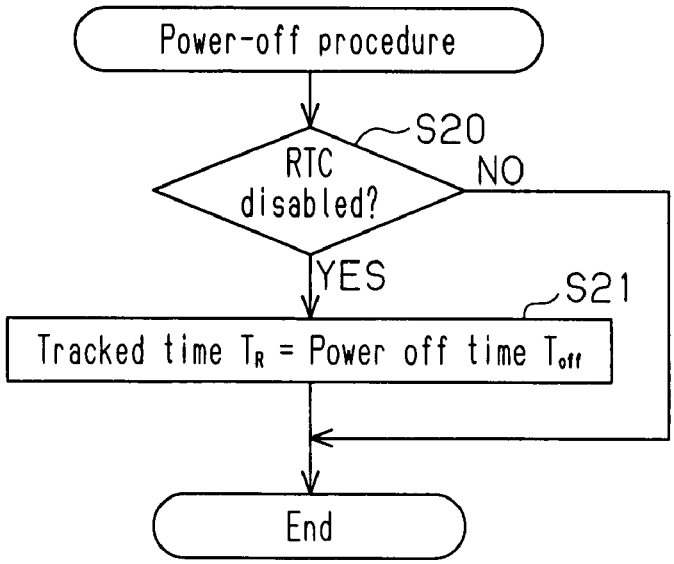
FIG. 5 is a flowchart representing a routine of a power-on procedure of the first embodiment.
Figure 6:
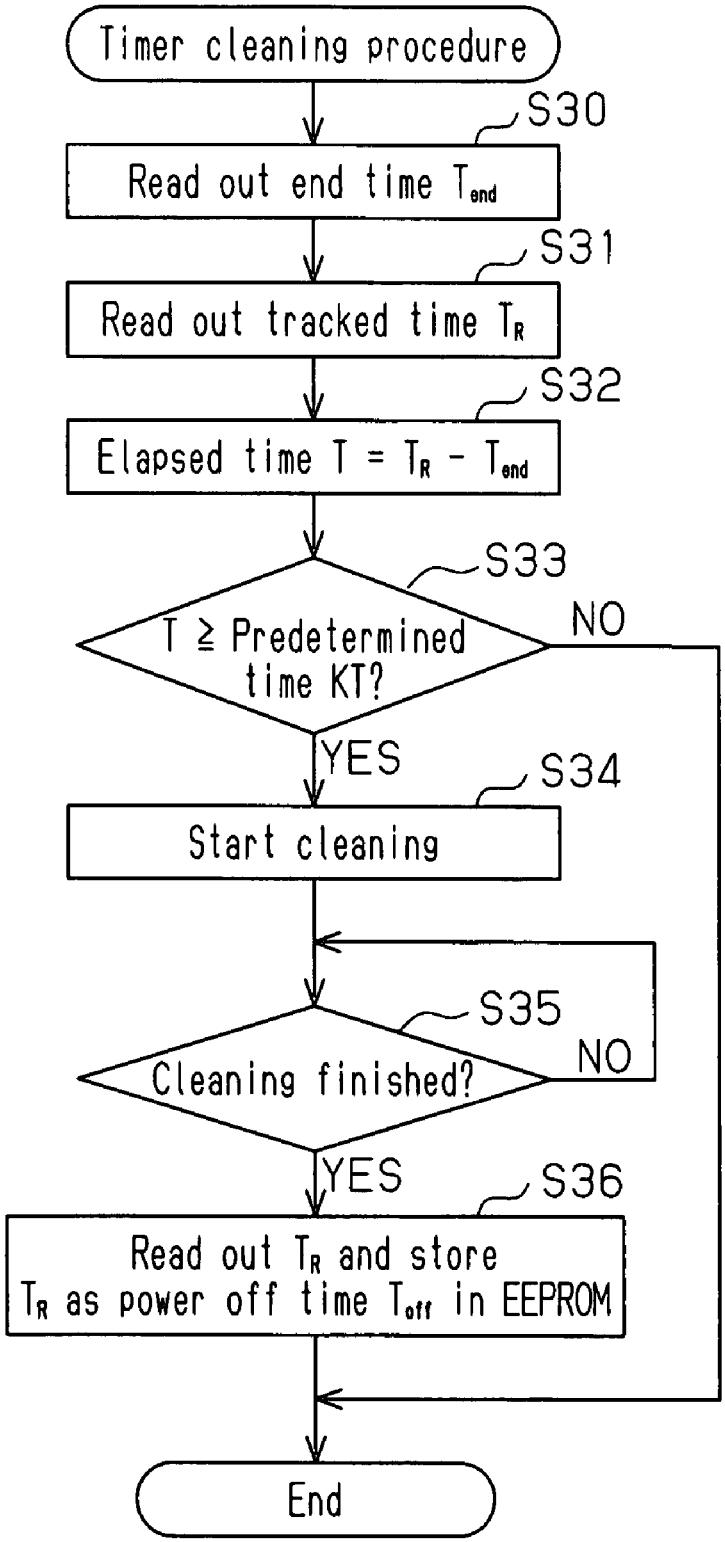
FIG. 6 is a flowchart representing the routine of a timer cleaning procedure of the first embodiment.

Next, the routine of the power-on procedure, which is illustrated in FIG. 5, will be explained with reference to the timing chart of FIG. 7.

When the power source switch SW is manipulated with the power supply to the printer 11 stopped, the controller 40 executes the routine of the power-on procedure. In step S20 of the routine, the controller 40 determines whether the RTC 46 is stopped. In other words, when the power supply to the printer 11 is re-started from a stopped state, the controller 40 determines whether the time tracking by the RTC 46 is stopped due to stopping of the power supply from the capacitor 47. In this regard, the controller 40 of the first embodiment functions as a determining section.

If the determination of step S20 is negative, or the controller 40 determines that the time tracking by the RTC 46 has been sustained by the power supply from the capacitor 47, the controller 40 ends the routine of the power-on procedure. If the determination of step S20 is positive, in Step 21, the controller 40 reads out power-off time information from the EEPROM 45 and sets the power-off time $T_{off}$ based on the power-off time information as the tracked time $T_R$.

Specifically, if the power source switch SW of the printer 11 is manipulated while the time tracking by the RTC 46 is maintained in a stopped state, as illustrated in FIG. 7, the RTC 46 starts the time tracking from the power-off time $T_{off}$. However, if the power source switch SW of the printer 11 is manipulated with the RTC 46 maintained in operation, the tracked time $T_R$ obtained by the RTC 46 is not corrected. In this regard, the controller 40 of the first embodiment functions as a tracked time correcting section. Following step S21, the controller 40 ends the routine of the power-on procedure.

Finally, the routine of the timer cleaning procedure of FIG. 6 will be explained.

The controller 40 performs the routine of the timer cleaning procedure at predetermined cycles (for example, every 0.1 seconds). In step S30 of the routine, the controller 40 reads out end time information from the EEPROM 45 and sets end time $T_{end}$ based on the end time information in the RAM 44. The end time $T_{end}$ is the tracked time $T_R$ tracked by the RTC 46 after the cleaning mechanism 23 finishes a previous cycle of cleaning. Then, in step S31, the controller 40 reads out the tracked time $T_R$ tracked by the RTC 46 and sets the tracked time $T_R$ in the RAM 44. In step S32, the controller 40 calculates the elapsed period T by subtracting the end time $T_{end}$, which has been set in the RAM 44 in step S30, from the tracked time $T_R$, which has been set in the RAM 44 in step S31.

Subsequently, in step S33, the controller 40 determines whether the elapsed period T calculated in step S32 is greater than or equal to a predetermined period KT (for example, seven days). The predetermined period KT is a reference value in accordance with which the cleaning mechanism 23 is operated to periodically perform cleaning. The value is determined through tests or simulations to prevent a defect in ink ejection. If the determination of step S33 is negative ($T<KT$), the controller 40 ends the routine of the timer cleaning procedure.

If the determination of step S33 is positive ($T \geqq KT$), the controller 40 performs cleaning in step S34. That is, after detecting that the carriage 16 is located in the home position area, the controller 40 drives the lift device 25 to seal the nozzle forming surface 19*a* of the recording head 19 by the cap 24. In this state, the controller 40 actuates the suction pump 31. Afterwards, in step S35, the controller 40 determines whether the cleaning by the cleaning mechanism 23 is completed. In other words, the controller 40 determines whether the suction pump 31 is stopped.

If the determination of step S35 is negative, the controller 40 repeatedly carries out the determination of step S35 until a positive determination is obtained. When the determination of step S35 is positive, the controller 40 reads out, in step S36, the tracked time $T_R$ tracked by the RTC 46 immediately after the positive determination is obtained in step S35 as the end time $T_{end}$. The controller 40 stores the end time $T_{end}$ in the EEPROM 45 as the end time information.

Therefore, as illustrated in FIG. 7, when the power source of the printer 11 is turned on from a turned-off state and the RTC 46 resumes the time tracking from the power-off time $T_{off}$ read out from the EEPROM 45, cleaning at a premature timing is avoided. In this regard, the EEPROM 45 of the first embodiment functions also as end time information memory section. After completion of step S36, the controller 40 ends the routine of the timer cleaning procedure.

Accordingly, the first embodiment has the following advantages.

When the power supply to the inkjet printer (the liquid ejection apparatus) 11 is resumed with the time tracking by the RTC 46, or the timer device, held in a suspended state, the RTC 46 re-starts the time tracking from the power-off time $T_{off}$, which is indicated by the power-off time information (the tracked time information) memorized when the power supply to the printer 11 is stopped. Therefore, unlike a comparative case in which the time tracking by the RTC 46 is re-started from an initial state and cleaning by the cleaning mechanism 23 is carried out, unnecessary cleaning is suppressed. That is, even without receipt of time information from an external device such as a host computer, waste of ink, or liquid, caused by excessive cleaning is suppressed.

The power supply for the RTC 46 is formed by the capacitor 47. During the time period the power is supplied to the printer 11, the capacitor 47 is charged. This effectively reduces the cost, compared to a case in which a rechargeable dry cell is used as a power supply.

Figure 8:
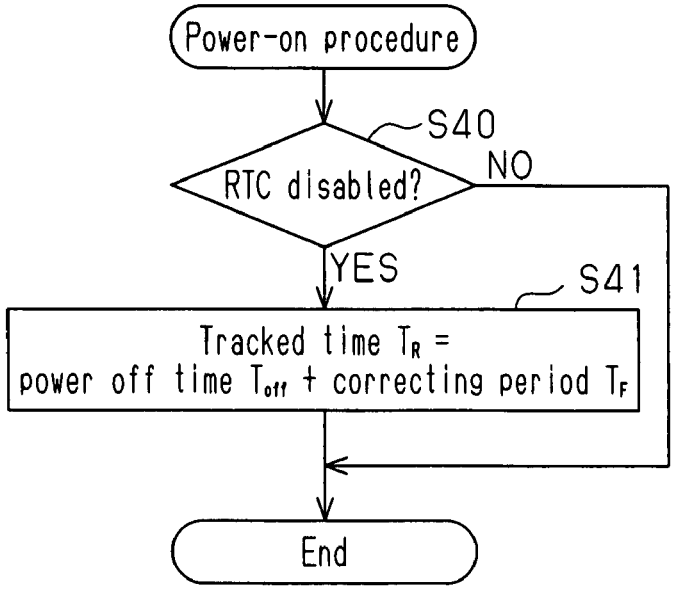
FIG. 8 is a flowchart representing the routine of a power-on procedure according to a second embodiment of the present invention.

Next, a second embodiment of the present invention will be described with reference to FIGS. 8 and 9. The second embodiment is different from the first embodiment in a part of a routine of a power-on procedure. The following description thus focuses on the differences between the second embodiment and the first embodiment. Same or like reference numerals are given to components of the second embodiment that are the same as or like the corresponding components of the first embodiment, and detailed explanation thereof will be omitted.

As one of the control routines executed by the controller 40 of the second embodiment, a routine of a power-on procedure will now be explained with reference to the flowchart of FIG. 8 and the timing chart of FIG. 9.

The controller 40 performs the routine of the power-on procedure when the power source switch SW is manipulated with the power supply to the printer 11 held in a stopped state. In step S40 of the routine, the controller 40 determines whether the RTC 46 is stopped. If determination of step S40 is negative, or the controller 40 determines that the time tracking by the RTC 46 is maintained in a state sustained by the power supply from the capacitor 47, the controller 40 suspends the routine of the power-on procedure.

If the determination of step S40 is positive, the controller 40 reads out power-off time information from the EEPROM 45 and correcting period information from the ROM 43 in step S41. The controller 40 then adds the correcting period $T_F$ based on the correcting period information to the power-off time $T_{off}$ based on the power-off time information, and sets the resultant ($T_{off}+T_F$) as the tracked time $T_R$. The correcting period $T_F$ is a period (for example, four days) in which the time tracking by the RTC 46 can be held in a sustained state in accordance with the capacitance of the capacitor 47 while the power supply to the printer 11 is maintained in a stopped state. The correcting period $T_F$ is set by a test or a simulation in advance.

Figure 9:
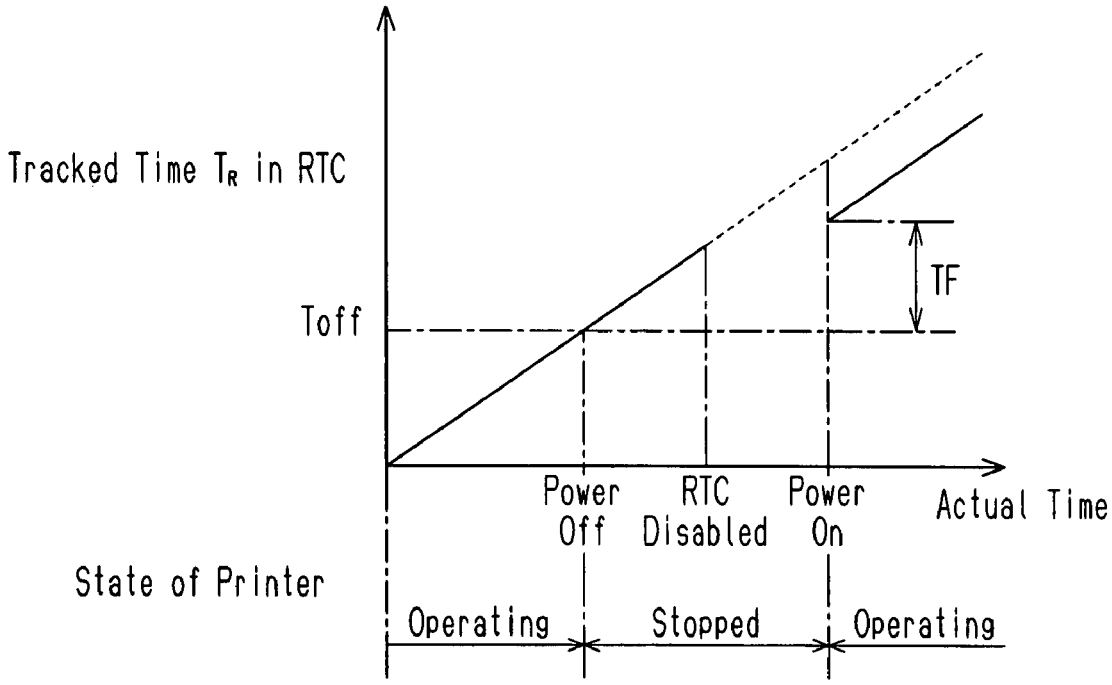
FIG. 9 is a timing chart representing correction of tracked time of the second embodiment.
Figure 10:
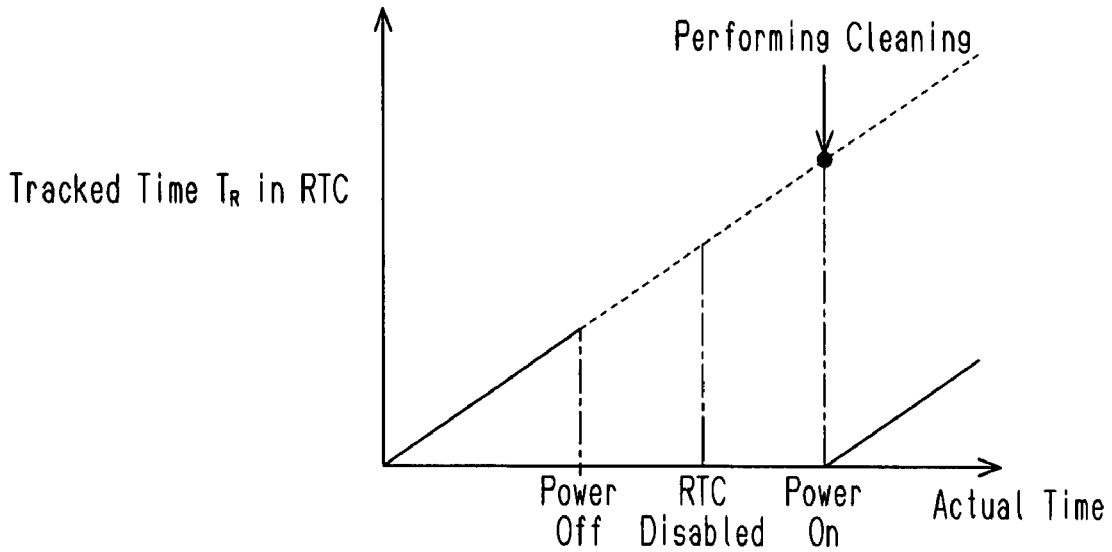
FIG. 10 is a timing chart representing time tracking of a comparative art.

Specifically, as illustrated in FIG. 9, if the power source switch SW of the printer 11 is manipulated with the RTC 46 held in a stopped state, the RTC 46 resumes the time tracking from the time obtained by adding the correcting period $T_F$ to the power-off time $T_{off}$. Therefore, compared to the first embodiment, the time tracking by the RTC 46 is re-started from the time more approximate to the actual time. If the period (the elapsed period) obtained by subtracting the end time $T_{end}$ from the tracked time $T_R$ tracked by the RTC 46 is longer than or equal to the predetermined period KT, the cleaning mechanism 23 is operated to perform cleaning. If the power source switch SW of the printer 11 is manipulated with the RTC 46 held in an operational state, the tracked time $T_R$ obtained by the RTC 46 is not corrected. After completing step S41, the controller 40 ends the routine of the power-on procedure.

The second embodiment has the following advantages in addition to the above-described two advantages of the first embodiment.

If the power supply to the inkjet printer (the liquid ejection apparatus) 11 is resumed with the time tracking by the RTC 46, or the timer device, held in a suspended state, the RTC 46 re-starts the time tracking from the time corresponding to the sum of the power-off time $T_{off}$, which is indicated by the power-off time information (the tracked time information) recorded when the power supply to the printer 11 has been stopped, and the correcting period $T_F$. Therefore, unlike a comparative case in which the time tracking by the RTC 46 is resumed from an initial state and the cleaning mechanism 23 carries out cleaning, cleaning is performed reliably at an optimal timing, suppressing unnecessary cleaning. Accordingly, even without reception of time information from an external device such as a host computer, waste of ink, or liquid, due to excessive cleaning is suppressed.

The correcting period $T_F$ is set in correspondence with the capacitance (permitted amount of charge) of the capacitor 47. If the correcting period $T_F$ is set longer than a period corresponding to the capacitance of the capacitor 47, the RTC 46 may indicate a time (a tracked time $T_R$) advanced from the actual time when the power supply to the printer 11 is resumed. This advances the timing at which cleaning is performed with respect to a correct timing at which the cleaning is supposed to be carried out. In this case, waste of ink, or liquid, caused by excessive cleaning occurs. However, in the second embodiment, if correction of the tracked time $T_R$ becomes necessary, the corrected tracked time $T_R$ is calculated by adding the period $T_F$ measured by the RTC 46 while the inkjet printer 11 is being held in a stopped state to the power-off time $T_{off}$ based on the power-off time information stored in the EEPROM 45. The RTC 46 re-starts the time tracking from the corrected tracked time $T_R$. Accordingly, cleaning is prevented from being carried out at a premature timing. This reliably suppresses waste of ink caused by excessive cleaning.

If the correcting period $T_F$ is set shorter than the period corresponding to the capacitance of the capacitor 47, the RTC 46 indicates the time (the tracked time $T_R$) retarded with respect to the case of the second embodiment when the power supply to the printer 11 is resumed. This retards the timing at which cleaning is performed, causing a defect in ink ejection. However, in the second embodiment, the correcting period $T_F$ is set depending on the capacitance of the capacitor 47. The timing at which cleaning is performed is thus prevented from becoming excessively retarded. This suppresses a defect in ink ejection.

The illustrated embodiments may be modified to the following forms.

In the second embodiment, the correcting period $T_F$ may be set to a period longer than the period corresponding to the capacitance of the capacitor 47 as long as the corrected tracked time $T_R$ does not exceed the actual time.

In any one of the illustrated embodiments, the power supply may be a rechargeable dry cell.

In any one of the illustrated embodiments, the tracked time information based on the tracked time $T_R$ obtained by the RTC 46 may be stored in the EEPROM 45 at certain timings (for example, every hour).

In any one of the illustrated embodiments, the liquid ejection apparatus may be a liquid ejection apparatus used in the manufacture of color filters such as liquid crystal displays or in the formation of pixels of an organic EL display, instead of the inkjet printer 11.

The present examples and embodiments are to be considered as illustrative and not restrictive and the invention is not to be limited to the details given herein, but may be modified within the scope and equivalence of the appended claims.

What is claimed is:

1. A liquid ejection apparatus including a liquid ejection head having a nozzle, a cleaning mechanism that performs cleaning of the nozzle by drawing a liquid from inside the nozzle, and a controller that controls operation of the liquid ejection apparatus, wherein the controller includes:

a timer device that tracks time;

a first memory section that stores an end time at which a previous cycle of the cleaning has ended as end time information;

a second memory section that stores a tracked time tracked by the timer device as tracked time information;

a power supply that is charged when a power is supplied to the liquid ejection apparatus and supplies the charged power to the timer device when power supply to the liquid ejection apparatus is stopped;

a determining section that determines whether time tracking by the timer device is stopped; and a tracked time correcting section, wherein, if determination of the determining section is positive when the power supply to the liquid ejection apparatus is resumed after having been stopped, the tracked time correcting section reads out the tracked time information from the second memory section and causes the timer device to start the time tracking from the time indicated by the tracked time information that was stored when power supply to the liquid ejection apparatus was stopped;

wherein, if the controller determines that the difference between the tracked time tracked by the timer device and the end time indicated by the end time information stored in the first memory section is longer than or equal to a predetermined period, the controller operates the cleaning mechanism to carry out the cleaning.

2. The liquid ejection apparatus according to claim 1, wherein the power supply is a capacitor.

3. A liquid ejection apparatus including a liquid ejection head having a nozzle, a cleaning mechanism that performs cleaning of the nozzle by drawing a liquid from inside the nozzle, and a controller that controls operation of the liquid ejection apparatus, wherein the controller includes:

a timer device that tracks time;

a first memory section that stores an end time at which a previous cycle of the cleaning has ended as end time information;

a second memory section that stores a tracked time tracked by the timer device as tracked time information;

a power supply that is charged when a power is supplied to the liquid ejection apparatus and supplies the charged power to the timer device when power supply to the liquid ejection apparatus is stopped;

a determining section that determines whether time tracking by the timer device is stopped; and a tracked time correcting section, wherein, if determination of the determining section is positive when the power supply to the liquid ejection apparatus is resumed after having been stopped, the tracked time correcting section reads out the tracked time information from the second memory section and causes the timer device to start the time tracking from the time determined by adding a predetermined correcting period to the time indicated by the tracked time information that was stored when power supply to the liquid ejection apparatus was stopped;

wherein, if the difference between the tracked time tracked by the timer device and the end time indicated by the end time information stored in the first memory section is longer than or equal to a predetermined period, the controller operates the cleaning mechanism to carry out the cleaning.

4. The liquid ejection apparatus according to claim 3, wherein the correcting period is set in correspondence with a permitted amount of charge of the power supply.

5. The liquid ejection apparatus according to claim 3, wherein the power supply is a capacitor.

6. A method for cleaning a liquid ejection apparatus, the liquid ejection apparatus having a liquid ejection head including a nozzle, cleaning being performed on the nozzle by drawing a liquid from inside the nozzle, wherein the method comprises:

tracking time;

storing an end time at which a previous cycle of the cleaning has ended as end time information;

storing tracked time information of the tracked time;

determining whether time tracking is stopped;

causing, if the determining is positive when the power supply to the liquid ejection apparatus is resumed after having been stopped, a timer device to start the time tracking from the time indicated by the tracked time information that was stored when power supply to the liquid ejection apparatus was stopped; and performing the cleaning if the difference between the tracked time and the end time indicated by the end time information is longer than or equal to a predetermined period.

7. A method for cleaning a liquid ejection apparatus, the liquid ejection apparatus having a liquid ejection head including a nozzle, cleaning being performed on the nozzle by drawing a liquid from inside the nozzle, wherein the method comprises:

tracking time;

storing an end time at which a previous cycle of the cleaning has ended as end time information;

storing tracked time information of the tracked time tracked by a timer device;

determining whether time tracking is stopped;

causing, if the determining is positive when the power supply to the liquid ejection apparatus is resumed after having been stopped, the timer device to start the time tracking from the time determined by adding a predetermined correcting period to the time indicated by the tracked time information that was stored when power supply to the liquid ejection apparatus was stopped; and performing the cleaning if the difference between the tracked time and the end time indicated by the end time information is longer than or equal to a predetermined period.

8. The method according to claim 7, wherein the correcting period is set in correspondence with a permitted amount of charge of the power supply.

* * * * *